US007168218B2

(12) United States Patent
Spratlen et al.

(10) Patent No.: US 7,168,218 B2
(45) Date of Patent: Jan. 30, 2007

(54) MORTARLESS FENCE BLOCK SYSTEM

(76) Inventors: David Stalder Spratlen, 6624 W. Hinsdale Pl., Littleton, CO (US) 80128; David Stalder Spratlen, II, 6624 W. Hinsdale Pl., Littleton, CO (US) 80128

( * ) Notice: Subject to any disclaimer, the term of this patent is extended or adjusted under 35 U.S.C. 154(b) by 343 days.

(21) Appl. No.: 10/866,653

(22) Filed: Jun. 11, 2004

(65) Prior Publication Data

US 2005/0284077 A1 Dec. 29, 2005

(51) Int. Cl.
*E04C 2/04* (2006.01)

(52) U.S. Cl. ..... 52/604; 52/606; 52/605

(58) Field of Classification Search ..... 52/606, 52/605, 607, 596, 599; 405/286; D25/113, D25/112, 604

See application file for complete search history.

(56) References Cited

U.S. PATENT DOCUMENTS

| | | | | |
|---|---|---|---|---|
| 2,942,115 | A | 6/1960 | O'Connell | |
| 3,036,407 | A * | 5/1962 | Dixon | 52/585.1 |
| 3,422,588 | A * | 1/1969 | Stewart, Jr. | 52/436 |
| 4,031,678 | A | 6/1977 | Schuring | |
| 4,040,225 | A | 8/1977 | Bretone | |
| 4,110,949 | A * | 9/1978 | Cambiuzzi et al. | 52/437 |
| 4,123,881 | A | 11/1978 | Muse | |
| 4,309,135 | A | 1/1982 | Gutshall | |
| D295,788 | S | 5/1988 | Forsberg | |
| D295,790 | S | 5/1988 | Forsberg | |
| D296,007 | S | 5/1988 | Forsberg | |
| D296,365 | S | 6/1988 | Forsberg | |
| D297,464 | S | 8/1988 | Forsberg | |
| D297,574 | S | 9/1988 | Forsberg | |
| D297,767 | S | 9/1988 | Forsberg | |
| D298,463 | S | 11/1988 | Forsberg | |
| D299,067 | S | 12/1988 | Forsberg | |
| 4,802,320 | A | 2/1989 | Forsberg | |
| D300,253 | S | 3/1989 | Forsberg | |
| D300,254 | S | 3/1989 | Forsberg | |
| D301,064 | S | 5/1989 | Forsberg | |
| 4,825,619 | A | 5/1989 | Forsberg | |
| 4,914,876 | A * | 4/1990 | Forsberg | 405/286 |
| 4,920,712 | A | 5/1990 | Dean, Jr. | |
| 4,996,813 | A | 3/1991 | Kliethermes, Jr. et al. | |
| D317,048 | S | 5/1991 | Forsberg | |
| 5,031,376 | A | 7/1991 | Bender et al. | |
| 5,040,225 | A | 8/1991 | Gouge | |
| 5,044,834 | A | 9/1991 | Janopaul, Jr. | |
| RE34,314 | E | 7/1993 | Forsberg | |
| 5,429,451 | A | 7/1995 | Pettee, Jr. | |
| 5,487,623 | A * | 1/1996 | Anderson et al. | 405/286 |
| 5,551,809 | A | 9/1996 | Forsberg | |
| 5,568,994 | A | 10/1996 | Dawson | |
| 5,588,262 | A | 12/1996 | Dawson | |
| 5,601,384 | A | 2/1997 | Dawson | |

(Continued)

*Primary Examiner*—Basil Katcheves
(74) *Attorney, Agent, or Firm*—Sheridan Ross P.C.

(57) ABSTRACT

Concrete molded fence blocks are provided having cores for receiving mortar or aggregate, and pin openings for receiving pins that interlock and align abutting courses of blocks in a fence block system. Groups of a column of blocks form a column support. Standard blocks are provided as spans between the column supports. Column blocks provide additional structural integrity to the fence system, and are larger in comparison to the standard blocks. The leading and trailing edges of the standard blocks have complimentary shapes to provide further interlocking capability between individual blocks. Various types of column blocks are provided for managing the layout of a particular fence system.

21 Claims, 8 Drawing Sheets

U.S. PATENT DOCUMENTS

D380,560 S 7/1997 Forsberg
D381,086 S 7/1997 Forsberg
D384,168 S 9/1997 Stevenson
D387,434 S 12/1997 Dawson
5,711,130 A 1/1998 Shatley
5,771,631 A 6/1998 Dawson
5,775,838 A 7/1998 Pettee, Sr.
5,779,391 A 7/1998 Knight
D397,230 S 8/1998 Forsberg
D397,451 S 8/1998 Stevenson
5,795,105 A * 8/1998 Guth ..... 405/284
D397,808 S 9/1998 Dawson
5,802,792 A 9/1998 Fielding et al.
5,855,102 A 1/1999 Chang
5,865,006 A 2/1999 Dawson
5,913,790 A 6/1999 Dawson
D430,308 S 8/2000 Dawson
6,149,352 A 11/2000 MacDonald
6,226,951 B1 * 5/2001 Azar ..... 52/604
RE37,278 E 7/2001 Forsberg
D448,857 S 10/2001 Staten et al.
D459,006 S 6/2002 Staten et al.
6,447,213 B1 9/2002 MacDonald
6,536,994 B2 3/2003 Race
6,591,547 B1 7/2003 Staten et al.
D479,341 S 9/2003 Scullion et al.
D479,342 S 9/2003 Dawson
6,615,561 B2 9/2003 MacDonald et al.
6,637,981 B2 10/2003 MacDonald
6,709,201 B2 3/2004 Race
D488,242 S 4/2004 MacDonald
D488,568 S 4/2004 MacDonald
D488,569 S 4/2004 Dawson
D490,542 S 5/2004 MacDonald
6,893,192 B2 5/2005 MacDonald
2005/0072095 A1 4/2005 MacDonald

* cited by examiner

MORTARLESS FENCE BLOCK SYSTEM

FIELD OF THE INVENTION

The present invention relates to blocks used in the construction of a wall or fence, and more particularly, to fence blocks used in a mortarless wall or fence construction, wherein pins are used to interlock and align the blocks.

BACKGROUND OF THE INVENTION

A multitude of construction methods and materials are available for the construction of fences and retaining walls. Common fence constructions include wood picket, stockade, chain length, concrete or stone columns with wood pickets spanning between the columns, and stone/brick fences, to name a few. Retaining walls are typically made of stone or brick, and may include reinforcement by incorporation of geotextile sheets.

Recently, segmental concrete retaining wall units that are dry stacked have become a popular product for the construction of retaining walls. Because the units are dry stacked, they are built without the use of mortar that reduces the cost of construction since the services of a stone mason are not required, as well as savings realized in material costs. Without the use of mortar, retaining walls must incorporate some feature that interlocks and aligns the individual block units.

One reference disclosing a mortarless retaining wall block and retaining wall system includes U.S. Pat. No. 6,615,561. This reference specifically discloses a retaining wall block having a core opening, pin receiving cavities, and pinholes. The pin receiving cavities and pinholes are arranged on the blocks symmetrically and substantially interior of the block corners thus resulting in a more structurally stable block yet permitting optimal alignment of the block cores when constructing a retaining wall. The cores may be filled with mortar or aggregate to increase the strength of the wall system.

Another example of a reference disclosing a retaining wall block is the U.S. Pat. No. 5,551,809. This reference also discloses retaining wall blocks including a core, pin receiving cavities, and pinholes. However, the arrangement of the pinholes and pin receiving cavities is such that each successive row is set back from a lower row to form a slope angle of between about 30–75°.

Another reference disclosing a wall block in a retaining wall construction is the U.S. Pat. No. 5,865,006. In this reference, the wall block includes a removable flange having pin apertures that pass through the flange and into the body of the block. This type of block allows construction of walls having flange connections between adjacent courses of blocks or, when the flange is removed, pin connections between adjacent courses of blocks.

The U.S. Pat. No. 6,447,213 discloses yet another type of retaining wall system wherein blocks have different face sizes. The blocks in this reference may also incorporate pins for interconnecting courses of blocks. The faces have varying sizes based on variations in width. These variations in width allow the retaining wall system to be built in a multitude of different linear or angular arrangements. Each block also has at least three faces that are textured to produce the appearance of natural stone.

U.S. Pat. No. 4,996,813 discloses a wall block especially adapted for use in reinforced concrete wall systems to produce a sound barrier. The front end of the block has a protruding bullet shaped nose. A rear end of the block has a cavity shaped to receive the bullet shaped nose of an adjacent block. Blocks can be vertically stacked, or may be staggered with respect to one another to provide offset courses of blocks. Pins are used to interconnect courses of blocks.

The construction of modular concrete retaining walls as disclosed in the above prior art references includes a few simple steps. First, a leveling pad of dense base material or non-reinforced concrete is placed, compacted and leveled. Next, the initial course of blocks is placed and leveled. For systems that utilize pins, the pins are then placed in each block in the designated pinholes. Next, a core fill material such as crushed rock aggregate is placed in the cores of the blocks and other spaces between the blocks to add mass and strength to the wall structure for strength, as well as to encourage drainage through the retaining wall. Succeeding courses of blocks are then placed in a pattern according to the design of the particular blocks. For example, succeeding courses of blocks may be placed in a pattern such that each block to be placed is located between the two blocks directly below it. Pin receiving cavities of the bottom blocks are configured to align with pinholes of the succeeding upper blocks thereby facilitating a pinned connection between upper and lower courses of blocks.

Although segmental block construction is well known for retaining walls, it is less common for construction of fences. Many housing developments include a perimeter fence that delineates the boundaries of the particular development. Because of the cost of placing conventional brick fences or decorative stone fences, perimeter fences surrounding a development are typically made of much less costly materials such as wood pickets. However, particularly in wetter climates, wood picket fences quickly deteriorate, and must be replaced frequently. When a fence begins to deteriorate, it reflects poorly on the quality and overall reputation of the particular development. As metropolitan areas continue to grow, traffic noise has created problems for many suburban neighborhoods that were once fairly remote and not subjected to high traffic noise. Wood fences are inadequate structures for creating a sound barrier.

Therefore, there is a need for an economical fence system having the attributes of a retaining wall in terms of permanency and strength, yet the fence system being especially adapted in a fence construction to include use of various block types to accommodate the number of required turns in a standard fence layout. Accordingly, the fence provided should be a permanent solution for perimeter fences, or any other locations that demand a more permanent solution to standard fence constructions. Additionally, there is a need for an economical fence construction that can reduce undesirable traffic noise.

SUMMARY OF THE INVENTION

In accordance with the present invention, a mortarless fence block and fence block system are provided that fulfill the needs discussed above. In one aspect of the invention, various types of fence blocks are provided that enable construction of a fence block system. A first general type of block is referred to as a standard block. A second general type of block is referred to as a column block. The column blocks are vertically stacked to provide a column support. A plurality of column supports are used along a particular section of fence. The gaps spanning between the column supports are filled by a plurality of the standard blocks.

Each standard block includes a front face, a rear face spaced from and substantially parallel to the front face, a nose or front portion that interconnects leading or forward edges of the front and rear faces, and a tail or trailing portion that interconnects trailing edges of the front and rear faces. The front portion of the standard block includes a pair of converging surfaces that extend in the leading direction, and terminate at a front edge. The rear portion of the standard block includes a trailing edge and a pair of diverging surfaces that diverge away from the trailing edge. The diverging surfaces each terminate at the line of intersection between the diverging surfaces and the respective front and rear faces. Each diverging surface and its corresponding trailing portion of the front/rear surface defines a flange or fin. A trailing chamfer may be made on the most trailing portion of each flange. Two central openings are provided in the standard block defining a pair of cores. Each core is spaced from one another along the long axis or longitudinal axis of the block. A pair of pinholes are formed in each standard block and extend vertically through the depths of the blocks. A longitudinal slot is formed on a lower surface of the block, the slot extending longitudinally along the lower surface. The block is symmetrical about a vertical plane intersecting the longitudinal axis of the block. A standard half block is also provided that is similar to the standard block, but approximately one-half the length of the standard block. The standard half block has a nose portion and tail portion of the same configuration as the standard block; however, the standard block has a single core and a single pinhole.

The column blocks of the present invention include various types each having a particular shape that accommodates construction of a fence system. More specifically, a first type of column block includes a standard column block that is used to interconnect spans of standard blocks when a fence extends in a single direction. Another type of column block includes a T-column block that can interconnect a pair of spans extending in a single direction, and accommodates the connection of another span of standard blocks that extends perpendicular to the first pair of spans. Another type of column block includes a corner column block that can interconnect a pair of spans extending perpendicular to one another. Yet another type of column block includes an end block that provides an end or termination point for a particular span. Each of the column blocks has one or more recesses that are formed by pairs of flanges. The recesses are sized to receive the front and rear portions of the standard blocks. Each of the column blocks further include a single central core, and at least two pin openings formed through the block and extending vertically through the depth of the block. A corresponding number of pinhead cavities are also formed on a lower surface of the block. The pinhead cavities communicate with the pinholes and are vertically aligned with pinholes. The pinhead cavities have a larger diameter than that of the pin openings.

In another aspect of the invention, a block fence system is provided that incorporates the standard blocks, the standard half blocks, and the various types of column blocks. The system comprises at least one lower course of blocks, and at least one upper course of blocks, each course comprising a plurality of blocks laid in a pattern to suit the particular layout of the fence to be built. Each of the blocks in the lower course receive a pin inserted through the respective pinholes. Each of the pins includes a shaft and a head. The head of the pin has a larger diameter than that of the shaft. The head of the pin extends above the upper surface of the corresponding block in which it is inserted. The upper course is constructed by placing upper blocks over the lower course of blocks. For the column blocks, the upper course is joined to the lower course by aligning the heads of the pins with the pin cavities formed on the lower surface of the upper block. For the standard blocks, the pinheads are received in the longitudinal slots formed on the lower surface of the upper blocks.

Aggregate and/or mortar may be placed in the cores of each of the blocks to add mass and strength to a fence system. Additionally, rebar may be used to further reinforce the fence by placing lengths of rebar through the aligned cores. The rebar may be grouted in the cores. The rebar may also be grouted to a bond beam that serves as a lower support when constructing a fence.

BRIEF DESCRIPTION OF THE DRAWINGS

The preferred embodiments of the present invention will now be described by way of example with reference to the accompanying figures, wherein.

DETAILED DESCRIPTION

For the detailed description of the standard block and standard half block, many of the same reference numbers are used throughout to identify elements that are similar in shape, size, relative placement, and/or function. The same convention also applies for the detailed description of the various types of column blocks wherein many of the same reference numbers are used to identify elements that are similar in shape, size, relative placement, and/or function.

Figure 1:
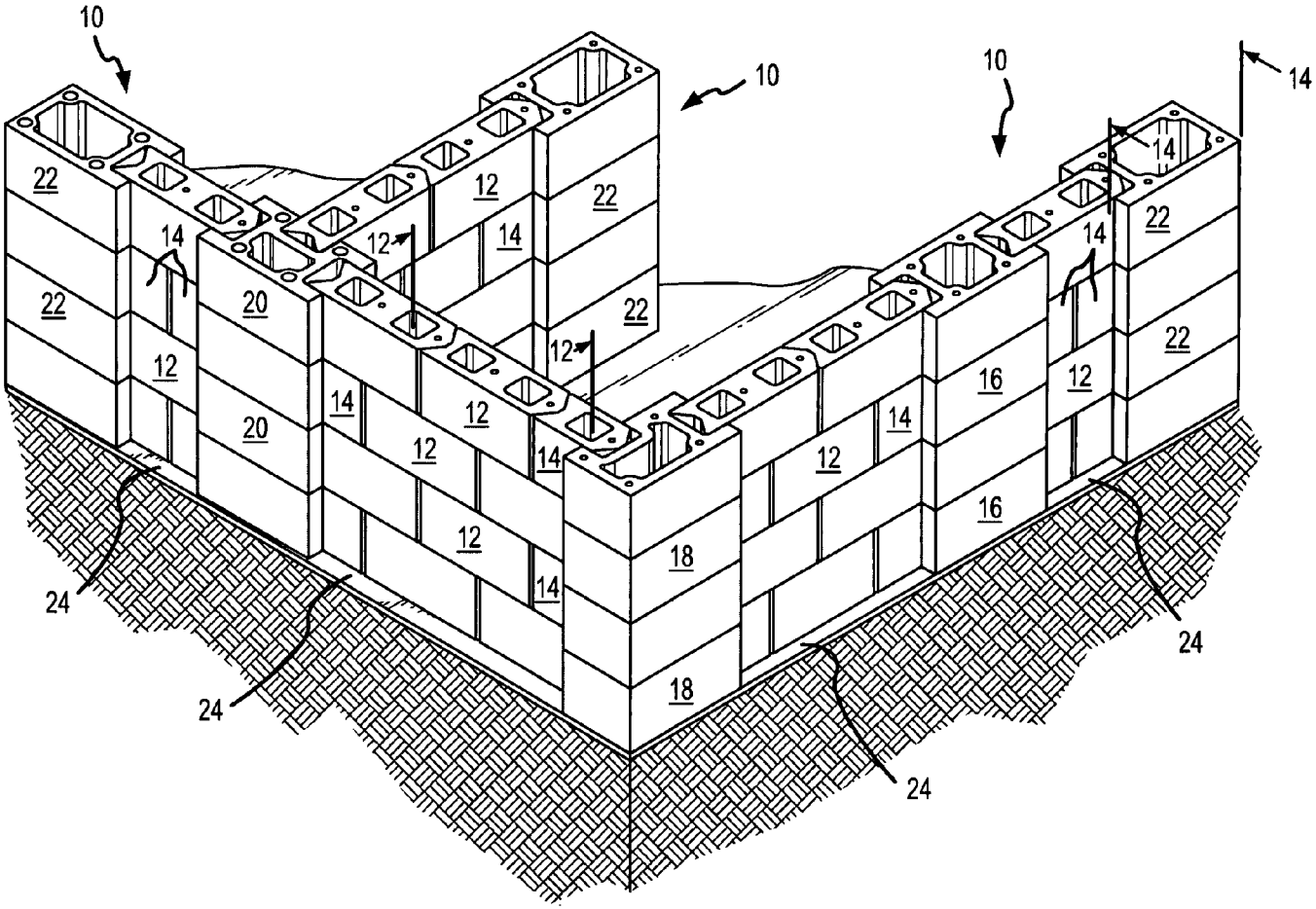
FIG. 1 is a perspective view of the block fence system of the present invention constructed in an example layout or pattern that incorporates each of the various types of blocks of the present invention.

Referring to FIG. 1, one example of a fence block system 10 is shown including standard blocks 12, standard half blocks 14, standard column blocks 16, corner column blocks 18, T-column blocks 20, and end column blocks 22. Groups of column blocks in the form of column supports are spaced from one another a desired distance, and standard blocks and standard half blocks span the gaps between the column blocks. While FIG. 1 represents one example in which blocks may be arranged, it will be apparent by those skilled in the art that the various types of block shown enable a fence builder to construct a fence that may be configured for use in many specific purposes to include, but not limited to, individual dwelling fences, development fences and the like.

In order to provide level base for a particular section of fence, a bond beam 24 may be used. Alternatively, a leveling pad of dense base material or non-reinforced concrete may be placed, compacted and leveled. After placement of the bond beam 24, successive courses or layers of blocks are then constructed over the bond beam 24.

The nose portion of a standard block is received in the tail portion of the adjacent standard block. The tail portion of a standard block that terminates one side of a span of standard blocks is received within the cavity of the adjacent column block. The nose portion of the standard block that terminates on one side of a span of standard blocks is received within the cavity of the adjacent column block. The complimentary shaped nose and tail portions of the standard blocks allow the standard blocks to span a distance of considerable length in the construction of a fence. The column supports are spaced from one another at desired intervals to provide the necessary additional support for the fence system and to provide a pleasing design feature as well.

Although FIG. 1 only show a maximum of two standard blocks and a standard half block as the longest span between groups of column blocks, it shall be understood that a number of additional standard blocks may be used to span the gap between column supports.

Figure 2:
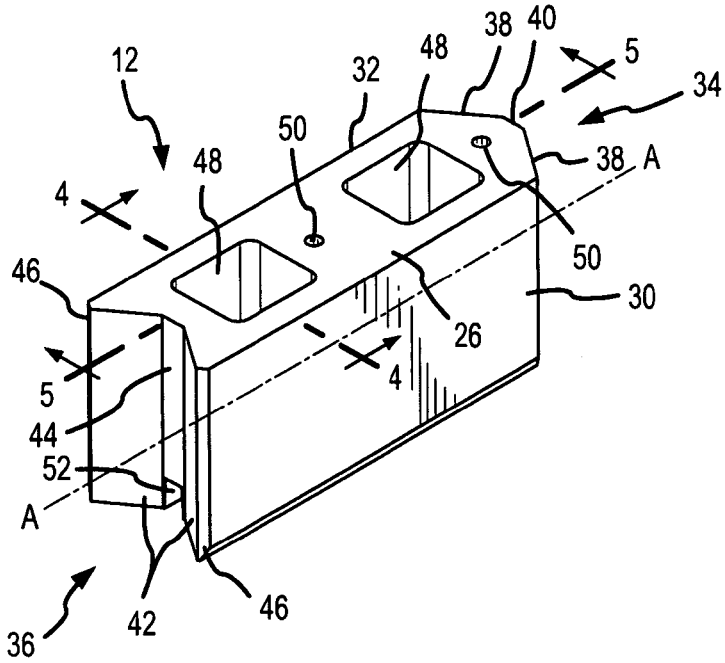
FIG. 2 is a perspective view of a standard block.
Figure 3:
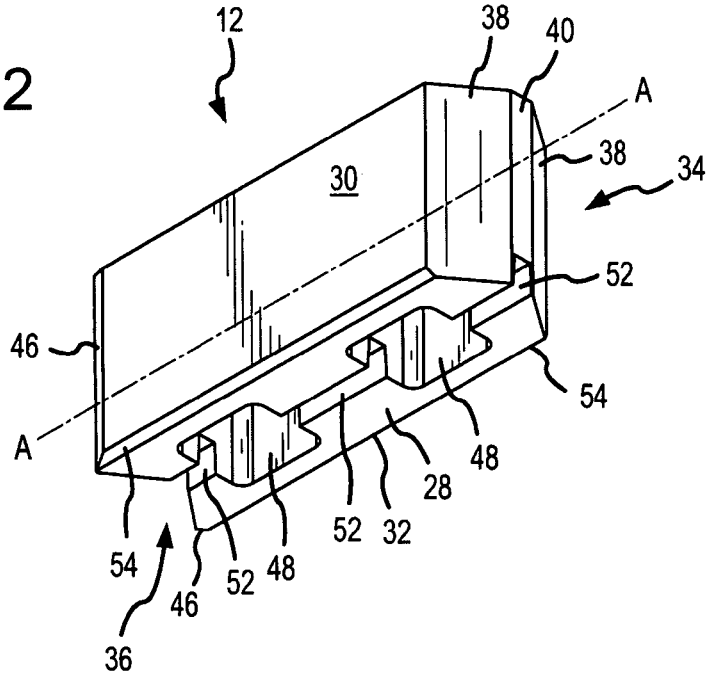
FIG. 3 is another perspective view of the standard block of FIG. 2.

Referring to FIG. 2, a standard block 12 is shown. The block 12 includes a front face 30, a rear face 32, upper surface 26, lower surface 28, nose or leading portion 34, and a trailing portion 36. Referring also to FIG. 3, the upper surface 26 and lower surface 28 are spaced from one another and extend substantially parallel to one another. The upper and lower surfaces extend substantially perpendicular to the front and rear faces. The front and rear faces extend substantially parallel to one another. The nose portion 34 includes a pair of converging surfaces 38, and a front edge 40. The trailing portion 36 includes a trailing edge 44, and a pair of diverging surfaces 42 that diverge away from the trailing edge 44 at substantially equal angles. The diverging surfaces intersect the respective front and rear faces along the trailing edges of the front and rear faces. A trailing chamfer 46 may be formed on the trailing edges. A pair of openings define a pair of cores 48. Pinholes 50 are formed through the block and extend vertically through the depth of the block.

Figure 4:
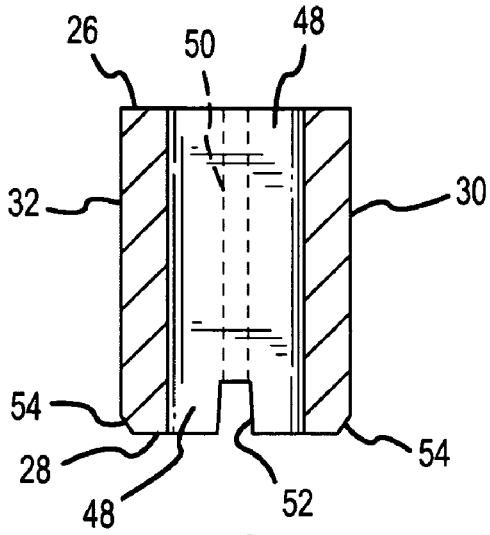
FIG. 4 is a vertical section taken along line 4—4 of FIG. 2.
Figure 5:
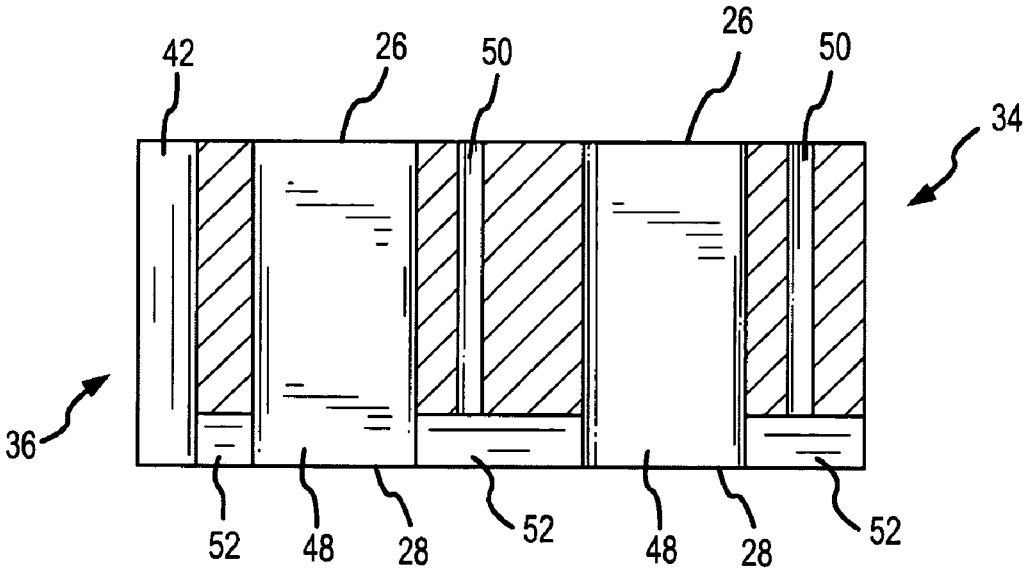
FIG. 5 is another vertical section taken along line 5—5 of FIG. 2.

As best seen in FIG. 3, the standard block 12 also includes a longitudinal slot 52 that extends through and along the lower surface of the block. The lower ends of the pinholes 50 communicate with the slots 52. Longitudinal axis A—A is shown wherein the block 12 is symmetrical about a vertical plane taken through the longitudinal axis. Preferably, the slot 52 and the pinholes 50 extend along a centerline of the block defined by the axis A—A. Referring to FIG. 4, a pinhole 50 is shown extending through the depth of the block and communicating with the sot 52. The slot 52 may have a substantially rectangular cross-sectional shape, or trapezoidal shape. FIG. 5 further illustrates interior details of the block, to include the slot 52, and the manner in which the pinholes 50 and the cores 48 extend through the depth of the block. As also shown in FIGS. 3 and 4, the lower edges of the front and rear faces may include a lower chamfer 54.

Figure 6:
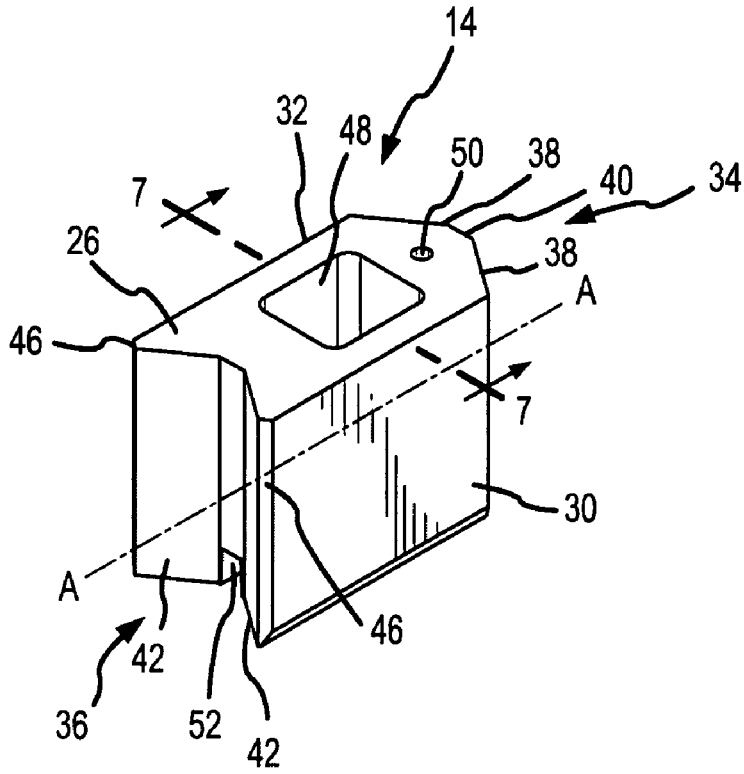
FIG. 6 is a perspective view of a standard half block.
Figure 7:
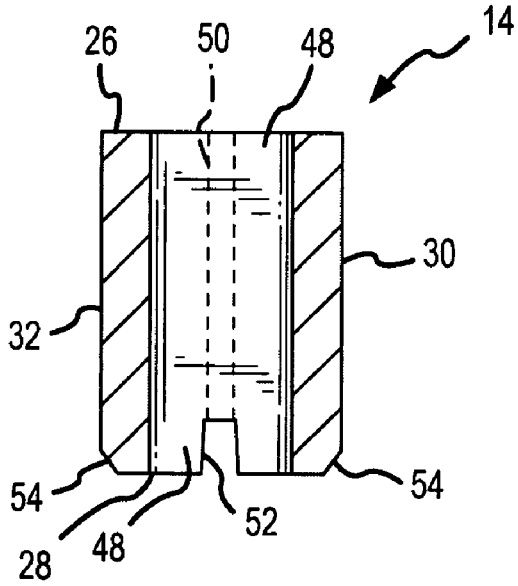
FIG. 7 is a vertical section taken along line 7—7 of FIG. 6.

FIG. 6 illustrates a standard half block 14. The standard half block is very similar to the construction of the standard block 12; however, the half block is approximately half the length of the standard block 12. Accordingly, the standard half block 14 preferably includes a single core 48, and a single pinhole 50.

Figure 8:
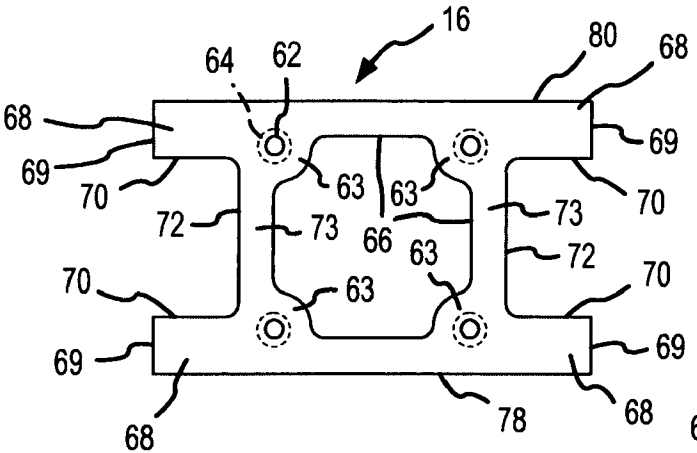
FIG. 8 is a plan view of a standard column block.

Referring to FIG. 8, a standard column block 16 is shown. The shape of the block 16 is defined by front and rear faces 78 and 80, and two pairs of flanges 68 that extend longitudinally, each flange being formed at a corner of the block. Webs 73 interconnect the front and rear faces. Each flange 68 is defined by an inner parallel face 70, a transverse edge 69, and a corresponding portion of the front or rear face. A transverse face 72 interconnects the spaced inner parallel faces 70. Each pair of flanges define a cavity. A large central core 66 is provided between the front and rear faces and the transverse faces 72. Near the base of each flange 68 is a pinhole 62 that extends through the depth of the block. In order to provide structural strength to the block, offset areas 63 are provided thereby increasing the sheer capacity of the block at that area. The offset areas are simply thickened parts of the block that surround each of the pinholes. The lower section or portion of each of pinhole 62 includes a corresponding pinhead cavity 64 that is simply an opening having a larger diameter than that of the pinhole. The pinhead cavities accommodate receipt of the heads of the pins, as discussed further below.

Figure 9:
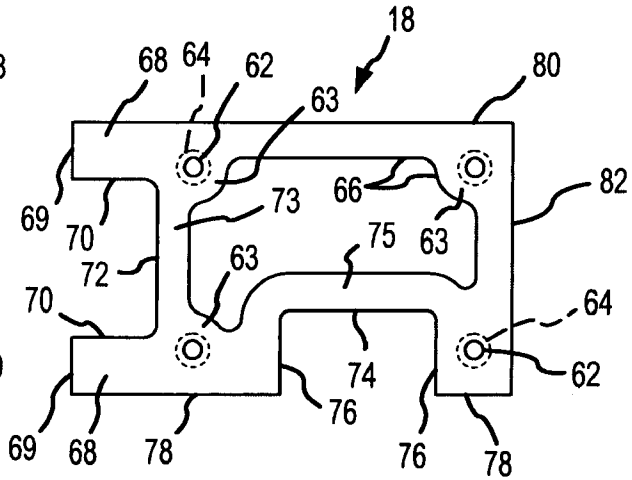
FIG. 9 is a plan view of a corner column block.

FIG. 9 illustrates a corner column block 18. Corner block 18 is similar to column block 16 by inclusion of a single pair of flanges 69; however, the second pair of flanges 69 are removed in favor of a transverse cavity defined by inner transverse faces 76 and inner parallel face 74. Transverse faces 76 extend substantially parallel to transverse face 72, and inner parallel face 74 extends substantially parallel to front and rear faces. Web 75 separates the transverse cavity from the core 66. The featureless end of the block 18 can be referred to as end face 82.

Figure 10:
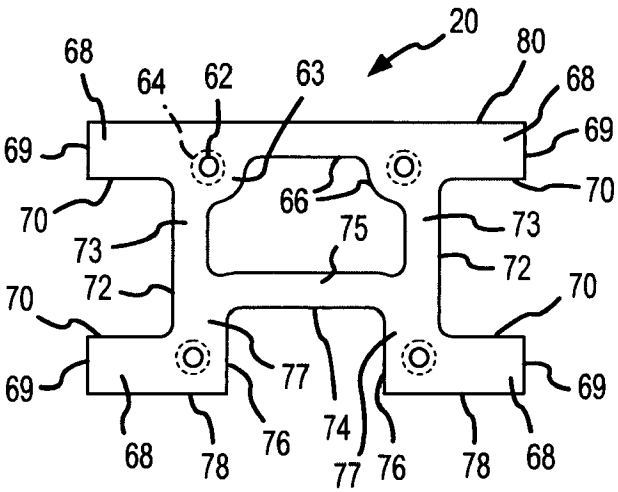
FIG. 10 is a plan view of a T-column block.

Referring to FIG. 10, the T-column block 18 is shown. The construction of this block is identical to the column block 12 with the exception of a transverse cavity formed on one face of the block, the transverse cavity being of the same configuration as the transverse cavity of the corner column block 18 shown in FIG. 9. Accordingly, the transverse cavity in the T-column block includes a pair of inner transverse faces 76, and a single inner parallel face 74.

Figure 11:
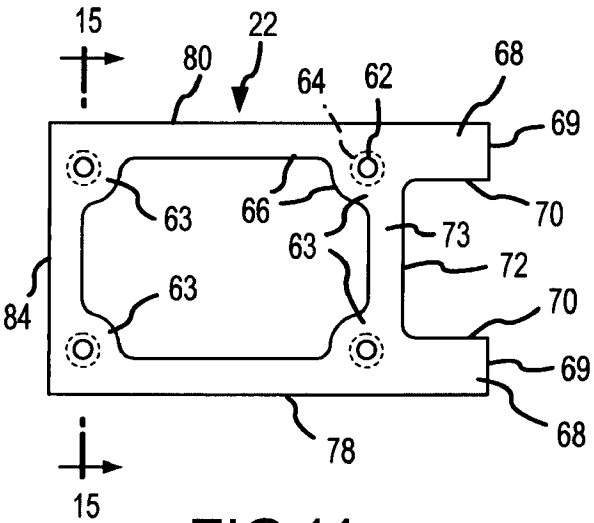
FIG. 11 is a plan view of an end column block.

Referring to FIG. 11, a column end block is shown. This block is similar to column block 12, but simply includes only one pair of flanges 69. Accordingly, the featureless end without the pair of flanges 69 is referred to as end face 84.

Figure 12:
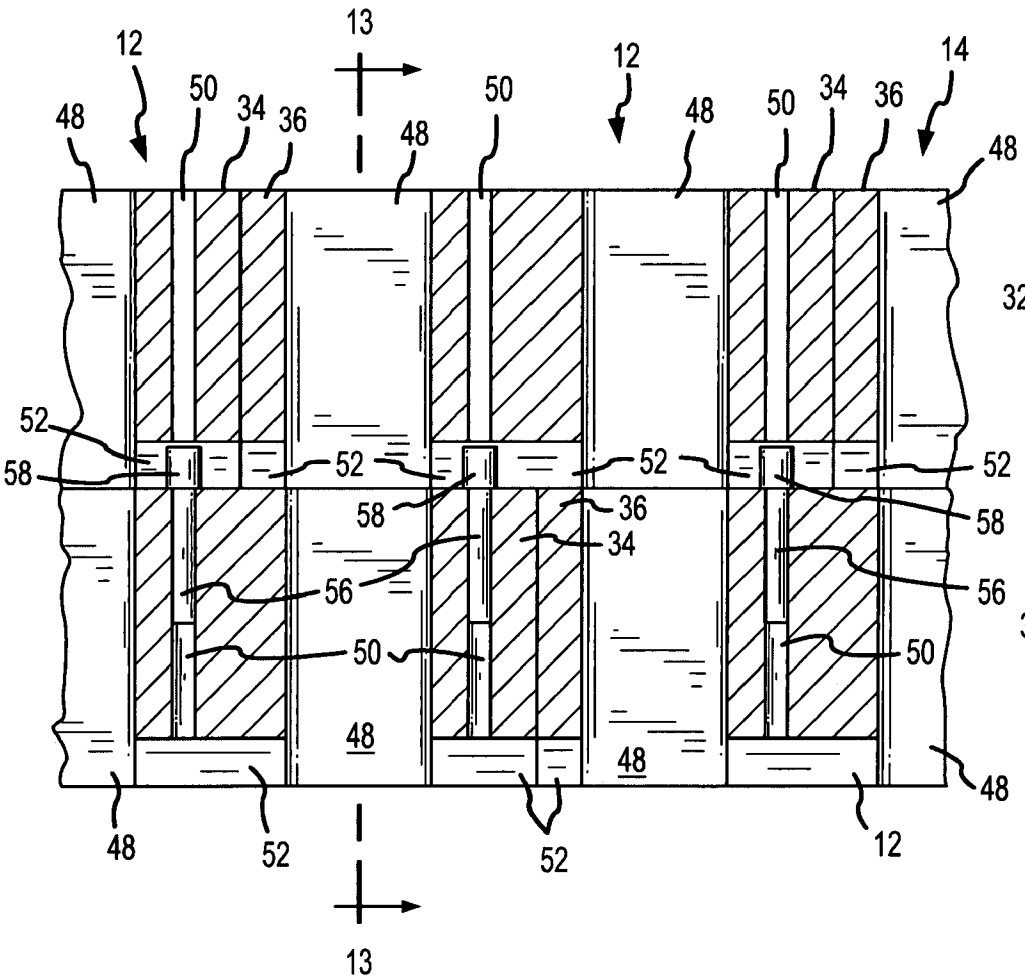
FIG. 12 is a vertical section taken along line 12—12 of FIG. 1.

Referring now to FIG. 12, a portion of the fence of FIG. 1 is shown in cross-section to illustrate the particular manner in which pins are used to interlock and align the fence.

Each pin includes a head 58 and a shaft 56. The lower course of blocks receive a pin so that the shaft of the pin extends through the pin openings 50. The head of the pins 58 extend above the upper surfaces of the lower course of blocks. The upper course of blocks are placed over the lower course, and the pinheads 58 are received in the respective channels 52. Because the channels 52 are continuous along the length of the blocks, it is thereby unnecessary for an installer to see the pinheads when placing an upper course of blocks. It is only necessary to initially align the upper course of blocks with respect to the front and rear faces of the lower blocks so that the upper course sets flush against the lower course. If any of the upper blocks do not set flush, then this indicates that the pins are not properly received in the slots 52. An installer can easily adjust the location of each upper block over the lower blocks by sliding the block to the desired position.

The positioning of the pinholes 50 allow the standard blocks to be placed in a typical staggered pattern, as shown in FIG. 1 wherein successive courses of blocks are shifted by one half of a standard block length. However, the standard blocks can be stacked in vertical alignment if desired so there is no staggering between courses of blocks.

Figure 13:
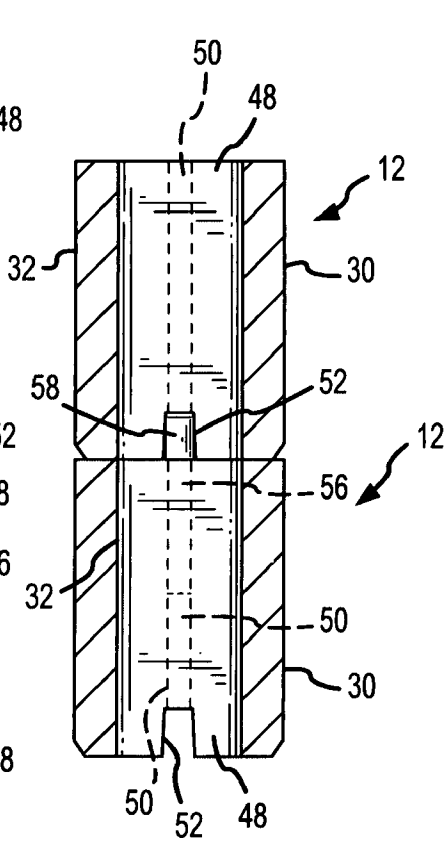
FIG. 13 is a vertical section taken along line 13—13 of FIG. 12.

FIG. 13 also shows proper pin emplacement wherein the head 58 of a pin extends into the corresponding recess 52 of the upper block. The pinhead 58 can be sized so that it extends substantially the entire depth of the slot 52, or the pinhead 58 may extend only partially through the depth of the slot 52. Also, with a slot having a trapezoidal cross-sectional shape, it is also possible to provide physical engagement of the pinhead against the surfaces defining the slot thereby further stabilizing the fence during construction until the cores are filled with mortar or aggregate.

Figure 14:
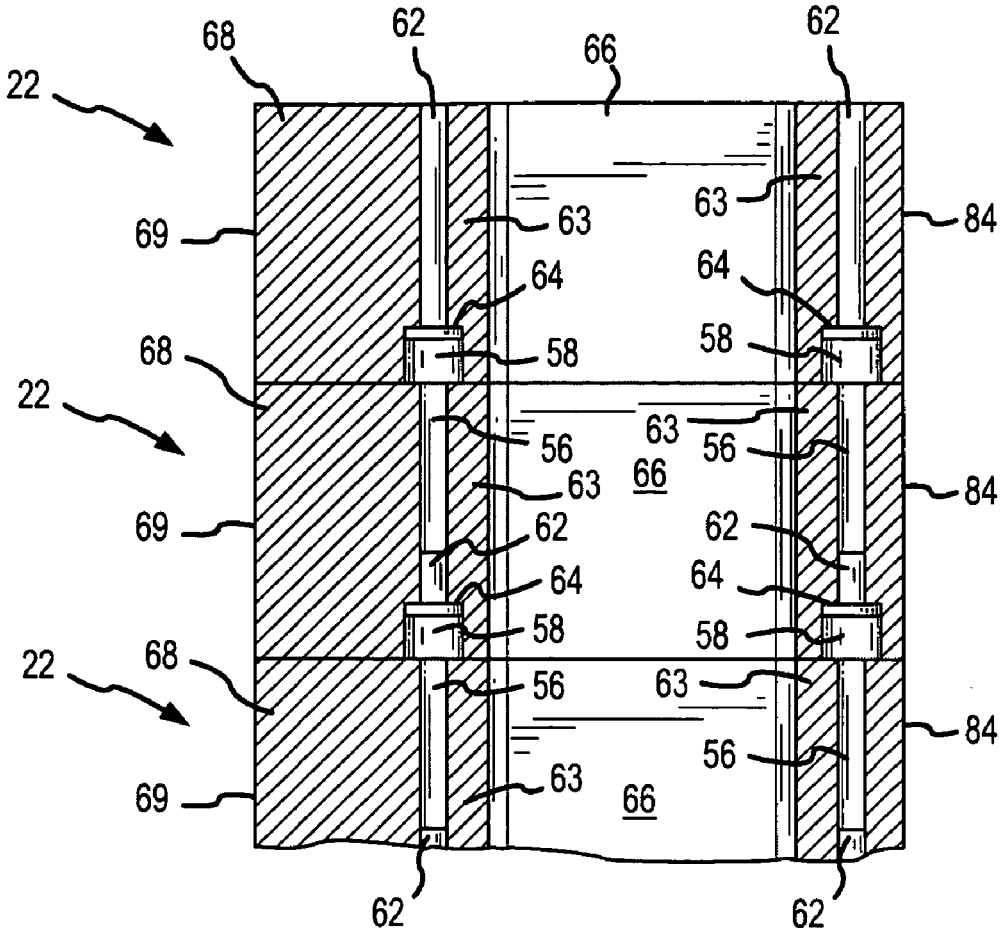
FIG. 14 is a vertical section taken along line 14—14 of FIG. 1.
Figure 15:
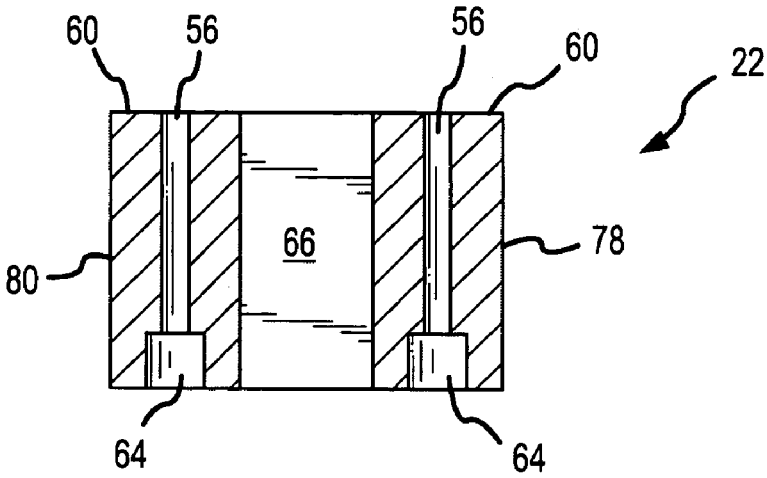
FIG. 15 is a vertical section taken along line 15—15 of FIG. 11.

FIG. 14 shows a vertical section taken along line 14—14 of FIG. 1. As shown, the column end blocks are stacked directly upon one another in a vertical fashion so that the pin holes 62 of a lower block align with the pinhead cavities 64 of the overlying block. Pins are inserted in each of the pinholes. The pinheads are received in the pinhead cavities 64 of the overlying blocks. The pinheads 58 may extend fully within the cavities 64, or a gap can be provided so that the pinheads do not completely fill the cavities. Also, it is shown that the pin shafts 56 do not extend the entire length of the pinhole 62, and rather extend only partly therethrough. The manner in which pins are incorporated in the other column blocks is the same as that illustrated in FIG. 14. More specifically, each of the column blocks are simply stacked upon one another so that the pins inserted in the pin openings of a lower block align with the pinhead cavities of the upper block.

Mortar or aggregate such as rock, crushed stone, or gravel may be placed within the cores to enhance the strength of the fence system. Since the cores of the blocks are aligned with one another between courses, filling of the cores can be achieved after the last course of blocks has been placed.

Additionally, rebar may be placed through the cores and used with mortar to further stabilize the fence system. Depending upon the particular fence application, it may be unnecessary to use any mortar or other fill material in the cores. The pins alone can be adequate in securing each of the individual blocks In order to complete the fence construction, cap members (not shown) may be installed over the top course of blocks. The caps may be especially designed to match a particular décor or style.

Figure 16:
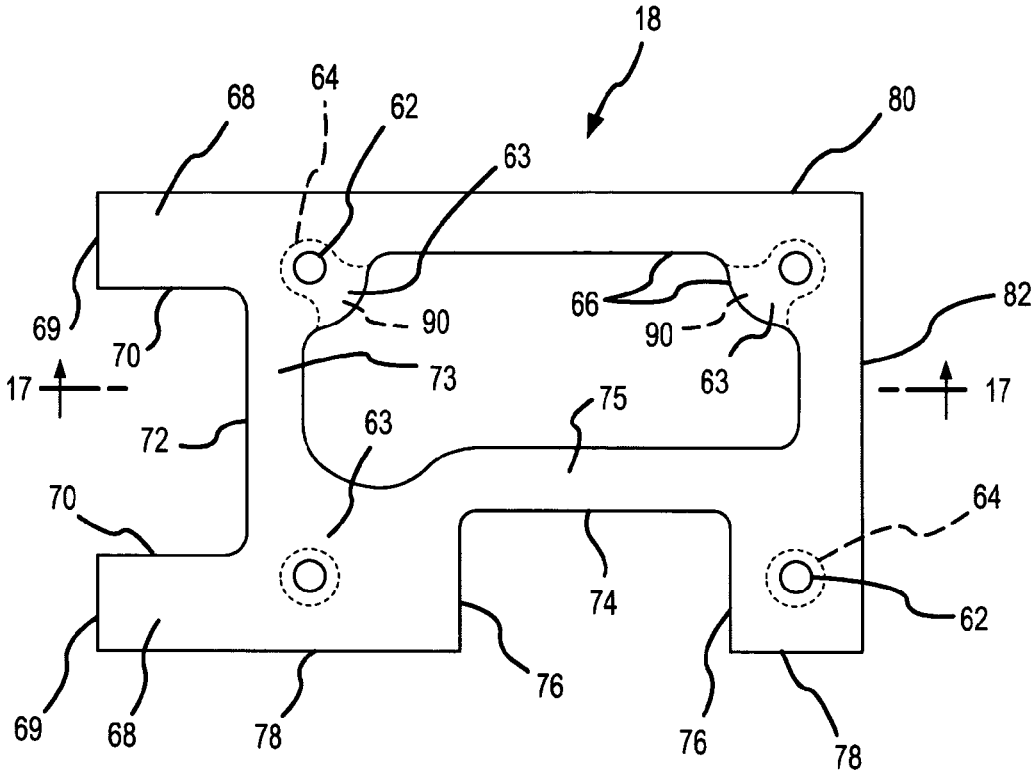
FIG. 16 is a plan view of a modified column block.
Figure 17:
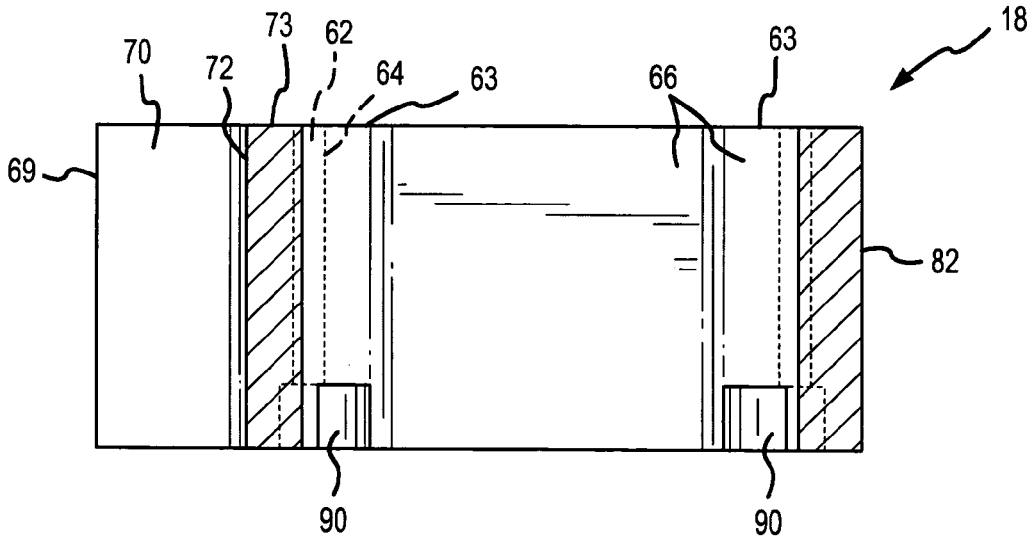
FIG. 17 is a vertical section taken along line 16—16 of FIG. 16.

FIG. 16 illustrates a modification that may be made to a column block. The modification is the creation of one or more transverse channels 90 that interconnect the pin head cavities 64 and the core of the block. If the core of the column block is filled with mortar or grout, the channels allows the mortar/grout to flow in contact with the heads of the pins, thereby providing additional reinforcement for tying the pins to the respective blocks. FIG. 17 illustrates the channels 90 having depths that are substantially equal to the depths of the pin head cavities; however, the channels may have greater or lesser depths based upon the amount of grout/mortar desired to provide reinforcement. Although a particular type of column block is shown in FIG. 16, it shall be understood that selected ones or all of the various types of column blocks may incorporate channels 90 in the same manner.

The blocks used in the present invention may be manufactured of concrete and cast in high speed masonry block machines. The openings which receive pins as well as the core openings are formed using core formers in the machines. Core formers may be tapered so that the bores formed in the blocks are somewhat wider at the upper surface of the block as compared to the lower surface of the block. Tapering eases manufacturing by not requiring core pullers to be used to pull the core formers away from the blocks after the blocks have set. Thus, although the figures of the present invention show that the pinholes have a uniform diameter and that the cores are vertically formed through the depth of the blocks, it shall be understood that there may be a slight tapering of both the pinholes and cores from the upper surface toward the lower surface of the block to accommodate manufacturing.

It is also contemplated within the present invention to provide a desired surface texture. For example, it is well known in the art to form blocks as mirror image pairs joined at a front face, and then a block splitter is used to split the blocks to create front faces having a rough texture. The exposed faces of the blocks can be treated to provide the desired texture or color. For example, the exposed faces can be painted for color or roughened for texture. Additionally, in the molding process, pigment can be added to also provide blocks with a desired color.

The blocks of the present invention provide many advantages. The blocks are especially adapted for use in a mortarless fence construction. Material costs may be reduced by use of standard blocks as spans between column supports. The standard blocks are smaller in size than column blocks, yet still provide adequate strength for a permanent fence solution. The various types of column blocks provide an adaptable fence system that accommodates typical fence layouts. The fence system is mortarless thereby eliminating the need for a skilled stonemason. The blocks are easily mass produced and are easy to install. Concrete has extreme durability and provides a permanent fence solution for most applications. The pins enable each block to be interlocked and aligned with surrounding blocks. The column blocks maximize core fill areas thereby providing sufficient mass to support long spans of standard blocks. The slots formed in the lower surfaces of blocks allow an installer to quickly locate a block for placement over the pin of a lower block.

Although the foregoing invention has been described in detail with respect to various block embodiments and a fence block system, the description of the preferred embodiments is for purposes of disclosure and is not intended to limit the scope of the appended claims. Thus, various modifications may be made to the invention without departing from the spirit and scope of the invention as defined by the claims.

What is claimed is:

1. A fence block comprising:

a front face;

a rear face substantially parallel to and spaced from said front face;

an upper surface interconnecting upper edges of said front and rear faces;

a lower surface substantially parallel to and spaced from said upper surface and interconnecting lower edges of said front and rear surfaces;

a leading portion extending from leading edges of said front and rear faces, said leading portion including a pair of converging surfaces;

a trailing portion inset with respect to trailing edges of said front and rear faces, said trailing portion including a pair of diverging surfaces;

at least one opening formed through said block defining a core;

a channel formed on said lower surface and extending along a longitudinal axis thereby bisecting said block along said axis; and at least one pin opening formed through said block from said upper surface and communicating with said channel, said pin opening extending substantially perpendicular to said axis.

2. A block, as claimed in claim 1, wherein:

said channel has a substantially rectangular shape in cross-section.

3. A block, as claimed in claim 1, wherein:

said channel has a pair of nonparallel opposing side edges.

4. A block, as claimed in claim 1, wherein:

said pin opening has a diameter that is smaller than a width of said channel.

5. A block, as claimed in claim 1, wherein:

said block is constructed of molded concrete.

6. A block, as claimed in claim 1, wherein:

said pin opening is centered along said longitudinal axis.

7. A block, as claimed in claim 1, wherein:

said core is substantially bisected by said longitudinal axis.

8. A block, as claimed in claim 1, wherein:

said converging surfaces are angled to converge toward said longitudinal axis.

9. A block, as claimed in claim 1, wherein:

said diverging surfaces are angled to diverge away from said longitudinal axis at substantially equal angles.

10. A block, as claimed in claim 1, further comprising:

a transverse channel formed on said lower surface and interconnecting said pin opening and said core.

11. A fence block comprising:

a front face;

a rear face spaced from said front face;

a web interconnecting said front and rear faces;

an upper surface interconnecting upper edges of said front edge rear faces;

a lower surface substantially parallel to and spaced from said upper surface and interconnecting lower edges of said front and rear surfaces;

a central opening formed through said block defining a core;

a pair of first flanges connected to said front and rear faces and forming respective first extensions of said front and rear faces, said pair of first flanges defining a first flange cavity;

at least one pin opening formed through said block near a base of one of said pair of first flanges, said pin opening having an upper end and a lower end, an offset area surrounding at least a portion of said pin opening, said offset area defining a thickened cross-section of said block, said pin opening being spaced from and not on said web.

12. A block, as claimed in claim 11, wherein:

said flange cavity is further defined by a pair of inner faces substantially parallel and spaced from one another, and defined by a transverse face interconnecting interior ends of said inner faces.

13. A block, as claimed in claim 11, wherein:

said upper end of said pin opening has a smaller diameter than a lower end of said pin opening.

14. A block, as claimed in claim 11, further comprising:

a transverse channel formed on said lower surface and interconnecting said pin opening and said core.

15. A fence block comprising:

a front face;

a rear face substantially parallel to and spaced from said front face;

an upper surface interconnecting upper edges of said front edge rear faces;

a lower surface substantially parallel to and spaced from said upper surface and interconnecting lower edges of said front and rear surfaces;

a central opening formed through said block defining a core;

a pair of first flanges connected to said front and rear faces and forming respective first extensions of said front and rear faces, said pair of first flanges defining a first flange cavity;

at least one pin opening formed through said block, said pin opening having an upper end and a lower end;

said block being symmetrical about a longitudinal axis;

a transverse cavity formed on one of said front and rear faces, said transverse cavity extending substantially perpendicular to said longitudinal axis; and an area of said first flange cavity is substantially equal to an area of said transverse cavity.

16. A block, as claimed in claim 15, wherein:

said transverse cavity is formed by a pair of opposing and substantially parallel inner transverse faces, each inner transverse face extending substantially perpendicular to a longitudinal axis, and an inner parallel face extending substantially parallel with said longitudinal axis, said inner parallel face interconnecting inner ends of said pair of inner transverse faces.

17. A fence block comprising:

a front face;

a rear face substantially parallel to and spaced from said front face;

an upper surface interconnecting upper edges of said front edge rear faces;

a lower surface substantially parallel to and spaced from said upper surface and interconnecting lower edges of said front and rear surfaces;

a central opening formed through said block defining a core;

a pair of first flanges connected to said front and rear faces and forming respective first extensions of said front and rear faces, said pair of first flanges defining a first flange cavity;

at least one pin opening formed through said block, said pin opening having an upper end and a lower end;

said block being symmetrical about a longitudinal axis;

a pair of second flanges connected to opposite ends of said front and rear faces, said second flanges forming respective second extensions of said front and rear faces, said second flanges defining a second flange cavity that is longitudinally aligned with said first flange cavity; and said first flange cavity, said second flange cavity, and said transverse cavity have substantially equal areas.

18. A block, as claimed in claim 17, wherein:

said first flange cavity has an area substantially equal to said second flange cavity.

19. A first course of a block fence comprising:

(a) first and second standard blocks each including:

(i) a front face;

(ii) a rear face substantially parallel to and spaced from said front face;

(iii) an upper surface interconnecting upper edges of said front and rear faces;

(iv) a lower surface substantially parallel to and spaced from said upper surface and interconnecting lower edges of said front and rear surfaces;

(v) a leading portion extending from leading edges of said front and rear faces, said leading portion including a pair of converging surfaces;

(vi) a trailing portion inset with respect to trailing edges of said front and rear faces, said trailing portion including a pair of diverging surfaces;

(vii) at least one opening formed through said block defining a standard core;

(viii) a channel formed on said lower surface and extending along a longitudinal axis thereby bisecting said block along said axis; and (ix) at least one standard pin opening formed through said block from said upper surface and communicating with said channel, said standard pin opening extending substantially perpendicular to said axis;

(b) a column block including:

(i) a front face;

(ii) a rear face substantially parallel to and spaced from said front face;

(iii) an upper surface interconnecting upper edges of said front edge rear faces;

(iv) a lower surface substantially parallel to and spaced from said upper surface and interconnecting lower edges of said front and rear surfaces;

(v) a central opening formed through said block defining a column core;

(vi) a pair of first flanges connected to said front and rear faces and forming respective first extensions of said front and rear faces, said pair of first flanges defining a flange cavity;

(vii) at least one column pin opening formed through said block, said column pin opening having an upper end and a lower end; and wherein said leading portion of said first standard block is received in said trailing portion of said second standard block, and said leading portion of said second standard block is received in said first flange cavity.

20. A fence block comprising:

a front face;

a rear face spaced from said front face;

an upper surface interconnecting upper edges of said front and rear faces;

a lower surface substantially parallel to and spaced from said upper surface and interconnecting lower edges of said front and rear surfaces;

a leading portion extending from leading edges of said front and rear faces, said leading portion including a pair of converging surfaces;

a trailing portion inset with respect to trailing edges of said front and rear faces, said trailing portion including a pair of diverging surfaces;

at least one opening formed through said block defining a core;

a channel formed on said lower surface; and at least one pin opening formed through said block from said upper surface and communicating with said channel, said pin opening extending substantially perpendicular to said upper and lower surfaces.

21. A first course of a block fence comprising:

(a) first and second standard blocks each including:

(i) a front face;

(ii) a rear face spaced from said front face;

(iii) an upper surface interconnecting upper edges of said front and rear faces;

(iv) a lower surface substantially parallel to and spaced from said upper surface and interconnecting lower edges of said front and rear surfaces;

(v) a leading portion extending from leading edges of said front and rear faces, said leading portion including a pair of converging surfaces;

(vi) a trailing portion inset with respect to trailing edges of said front and rear faces, said trailing portion including a pair of diverging surfaces;

(vii) at least one opening formed through said block defining a standard core;

(viii) a channel formed on said lower surface; and (ix) at least one standard pin opening formed through said block from said upper surface and communicating with said channel, said standard pin opening extending substantially perpendicular to said upper and lower surfaces; and wherein said leading portion of said first standard block is received in said trailing portion of said second standard block.

* * * * *